US011414730B2

(12) United States Patent
Ma et al.

(10) Patent No.: US 11,414,730 B2
(45) Date of Patent: Aug. 16, 2022

(54) MAGNESIUM ALLOYS, BICYCLE RIMS, AND PREPARATION METHODS

(71) Applicant: JURNONG BAILEY MAGNESIUM ALLOY MATERIAL TECHNOLOGY CO., LTD., Jurong (CN)

(72) Inventors: Chunjiang Ma, Jurong (CN); Jun Yang, Jurong (CN)

( * ) Notice: Subject to any disclaimer, the term of this patent is extended or adjusted under 35 U.S.C. 154(b) by 0 days.

(21) Appl. No.: 17/055,863

(22) PCT Filed: May 17, 2019

(86) PCT No.: PCT/IB2019/054111

§ 371 (c)(1),
(2) Date: Nov. 16, 2020

(87) PCT Pub. No.: WO2019/220416

PCT Pub. Date: Nov. 21, 2019

(65) Prior Publication Data

US 2021/0222272 A1 Jul. 22, 2021

(30) Foreign Application Priority Data

May 18, 2018 (CN) ..... 201810479021.4

(51) Int. Cl.

| | |
|---|---|
| ***C22C 23/04*** | (2006.01) |
| ***C22C 1/03*** | (2006.01) |
| ***C22C 1/10*** | (2006.01) |

(52) U.S. Cl.

CPC ..... *C22C 23/04* (2013.01); *C22C 1/03* (2013.01); *C22C 1/1036* (2013.01); *C22C 1/1084* (2013.01)

(58) Field of Classification Search

CPC ..... C22C 23/04

See application file for complete search history.

(56) References Cited

U.S. PATENT DOCUMENTS

| | | | | |
|---|---|---|---|---|
| 2,750,288 | A * | 6/1956 | De Navarro | C22C 23/04 148/401 |
| 6,471,797 | B1 | 10/2002 | Kim et al. | |
| 2009/0263271 | A1* | 10/2009 | Meng | C22F 1/06 420/406 |

FOREIGN PATENT DOCUMENTS

| | | | |
|---|---|---|---|
| CN | 1814836 | A | 8/2006 |
| CN | 101003875 | A | 7/2007 |
| CN | 108342630 | A | 7/2018 |

OTHER PUBLICATIONS

"International Search Report and Written Opinion dated Jul. 30, 2019."

Hongtao, et al., "Effects of Rare-earth Elements on Superplasticity of MB26 Magnesium Alloy", Journal of Materials Engineering, No. 2, Feb. 20, 1999, pp. 9-11.

(Continued)

*Primary Examiner* — Christopher S Kessler

(74) *Attorney, Agent, or Firm* — Billion & Armitage

(57) ABSTRACT

The present invention discloses magnesium alloys, bicycle rims made of magnesium alloys, and methods of preparing the alloys and bicycle components made of the alloys. The alloys may include the following components in percentage by weight: 5.5-6.0% of Zn, 0.3-0.6% of Zr, 0.5-2.0% of lanthanum-rich mixed rare earth and the balance of Mg.

15 Claims, 2 Drawing Sheets

(56) References Cited

OTHER PUBLICATIONS

Tao, et al., "Effect of homogeneous treatment on the microtexture and tensile properties of magnesium-zinc-zirconium-rare earth alloy extruded rods", pp. 150-153.
Tao, et al., "Phase analysis in magnesium-zinc-zirconium-rare earth alloy systems", pp. 52-57.

* cited by examiner

MAGNESIUM ALLOYS, BICYCLE RIMS, AND PREPARATION METHODS

RELATED APPLICATIONS

This application is a National Stage Application of PCT/IB2019/054111, filed on May 17, 2019, which claims benefit of Application No. 201810479021.4, filed on May 18, 2018 in China and which applications are incorporated herein by reference. A claim of priority to all, to the extent appropriate, is made.

BACKGROUND

Technical Field

The present invention relates to a magnesium alloy, a preparation method of a magnesium alloy section bar and a preparation method of a magnesium alloy rim, and belongs to the field of bicycle rim preparation.

Related Art

Traditionally, bicycle rims are made of steel materials or aluminum section bars. Magnesium alloy is the lightest metal structural material with a density of 1.78-1.82 g/cm$^3$, which is ⅔ density of aluminum alloy and ¼ density of steel materials, has the advantages of high specific strength and specific modulus, good damping and shock absorption performance, rich resources, easy recycling and the like, and is widely used in aerospace, automobile, rail transit and other transportation industries and favored by the sports equipment industry and the bicycle industry. Some companies try to design and manufacture bicycle frames, bicycle rims and other parts with the magnesium alloy.

However, the mechanical properties of conventional standard magnesium alloy materials, especially the yield strength, are low. After magnesium alloy rim section bars are bent and molded, the joint strength of a connecting part is low, and the compressive deformation of the rim exceeds the standard, which cannot meet the use requirements of bicycle rims.

SUMMARY

Objectives of the present invention: in view of the problems that existing magnesium alloy materials have poor mechanical properties and cannot meet the use requirements of bicycle rims, the first objective of the present invention is to provide a magnesium alloy, and the second objective is to provide a preparation method of a magnesium alloy section bar used as a bicycle rim, wherein the magnesium alloy section bar uses the magnesium alloy provided by the present invention as a raw material; and the third objective of the present invention is to provide a preparation method of a magnesium alloy rim with the magnesium alloy section bar as a raw material.

Technical scheme: a magnesium alloy of the present invention, including the following components in percentage by weight: 5.5-6.0% of Zn, 0.3-0.6% of Zr, 0.5-2.0% of yttrium-rich mixed rare earth and the balance of Mg.

The yttrium-rich mixed rare earth consists of Y and other rare earth elements, and the content of Y is 25-30 wt %. Preferably, the yttrium-rich mixed rare earth includes the following rare earths in percentage by weight: 25-30% of Y, 15-20% of Nd, 12-16% of Gd, 10-15% of Dy and the balance of other rare earths. More preferably, the yttrium-rich mixed rare earth consists of the following raw materials in percentage by weight: 25-30% of Y, 15-20% of Nd, 12-16% of Gd, 10-15% of Dy, 8-12% of La, 6-10% of Ce, 3-6% of Pr, 2-5% of Ho and 1-3% of Er.

A preparation method of a magnesium alloy section bar used as a bicycle rim in the present invention includes the following steps:

1) preparing a magnesium alloy bar stock according to a component formula of the magnesium alloy above; and 2) putting the magnesium alloy bar stock and a bicycle rim section bar mold into an electric heating furnace for heating to 300-400° C., and then taking the magnesium alloy bar stock out and putting into an extruder preheated to 300-380° C. in advance for rim section bar extrusion production to obtain a magnesium alloy section bar which meets the requirements for rim mechanical properties.

Specifically, in step 1), a preparation method of the magnesium alloy bar stock includes the following steps:

(1) material preparation: preparing a material according to a component formula and melting weight of the magnesium alloy bar stock, wherein Zr is added in the form of Mg-5Zr master alloy, yttrium-rich mixed rare earth is added in the form of Mg-10Re rare earth master alloy, and Re is the yttrium-rich mixed rare earth for short and the abbreviation of rare earth;

(2) melting: charging a prepared magnesium ingot into a heating furnace, covering the upper surface of the magnesium ingot with a layer of a magnesium alloy smelting covering agent, heating the furnace charge to 700-730° C., and after the magnesium ingot is completely melted, adding a zinc ingot, and Mg-5Zr master alloy and Mg-10Re rare earth master alloy blocks and stirring to obtain a magnesium alloy melt with uniform components; subjecting the melt to standing still, removing the smelting covering agent on the surface of a molten pool, heating the melt to 730-750° C., adding a magnesium alloy refining agent, and fully stirring the mixture for refining, and then subjecting the mixture to standing still and cooling to 680-700° C. to prepare for casting; and (3) casting: casting the magnesium alloy melt cooled to 680-700° C. into a cast rod crystallizer, and solidifying the magnesium alloy to form a magnesium alloy bar stock.

A preparation method of a magnesium alloy rim in the present invention, with the magnesium alloy section bar as a raw material, includes the following steps:

(1) sawing and coiling the magnesium alloy section bar, and then cutting the excess material near a rim joint;

(2) inserting a rim lining connecting piece into the magnesium alloy section bar at the rim joint and pressing the rim lining connecting piece into the rim joint completely, so that a rim connector is pressed and connected;

(3) drilling holes in both sides of the rim joint, wherein the holes go deep into the rim lining connecting piece from the inner side of a rim on which a tire is mounted, and welding at the hole forming positions to fix a rim inner lining and the rim;

(4) deburring and carrying out heat treatment to obtain the magnesium alloy rim.

Preferably, in step (3), the rim lining and the rim are fixed by argon arc welding with a welding wire.

In step (4), the heat treatment includes heating the deburred rim to 200° C. and keeping the temperature for 1-2 hours.

Beneficial effects: compared with the prior art, the advantages of the present invention are: (1) the magnesium alloy of the present invention uses Mg and Zn as the main alloy elements, a trace mount of rare earth elements such as Zr, Y, Nd, Gd and Dy are added to achieve the purposes of solid solution strengthening and grain refinement, and by using the stability of Y, Nd, Gd rare earth compounds to control grain growth in the subsequent extrusion process, the mechanical properties of magnesium alloy are greatly improved. With the magnesium alloy as a raw material, a magnesium alloy section bar meeting the requirements for mechanical properties of bicycle rims can be prepared. The mechanical properties of the prepared magnesium alloy section bar can reach the following indicators: $\sigma b \geq 380$ MPa, yield strength: $\sigma_{0.2} \geq 260$ MPa, and elongation: $\sigma \geq 12\%$; and (2) the preparation method of the magnesium alloy rim of the present invention uses the method of drilling and welding instead of the previous method of directly connecting a rim joint by pinning and inserting, the strength of the connected part of the prepared rim joint is greatly improved, the compressive deformation of the rim is low, and the use requirements of bicycle rims can be fully met.

DETAILED DESCRIPTION

The technical scheme of the present invention will be further described below in conjunction with the drawings.

Example 1 Preparation of a Magnesium Alloy Section Bar (1) Material Preparation Magnesium alloy components include 5.5% of Zn, 0.3% of Zr, 0.5% of yttrium-rich mixed rare earth and the balance of Mg, wherein the yttrium-rich mixed rare earth includes 27.2% of Y, 18.1% of Nd, 14.6% of Gd, 13.4% of Dy, 11.8% of La, 7.1% of Ce, 4.5% of Pr, 2.3% of Ho and 1.1% of Er.

Mg and Zn are added in the form of a magnesium ingot and a zinc ingot, the magnesium ingot and the zinc ingot are pressed into small pieces, Zr is added in the form of Mg-5Zr master alloy, and the yttrium-rich mixed rare earth is added in the form of Mg-10Re rare earth master alloy.

(2) Smelting

The prepared magnesium ingot charged into a crucible furnace, the upper surface of the magnesium ingot is covered with a layer of a magnesium alloy smelting covering agent, and the furnace charge is heated to 720° C.; after the magnesium ingot is completely melted, the zinc ingot, and Mg-5Zr master alloy and Mg-10Re rare earth master alloy block are added, and after the components are melt, a magnesium alloy melt is fully stirred with a stirrer to make components of the magnesium alloy melt uniform; the melt is subjected to standing still for 15 minutes, the covering agent on the surface of a molten pool is removed by a slag spoon, after the melt is heated to 740° C., a magnesium alloy refining agent is added, the magnesium alloy melt is fully stirred with a stirrer, the magnesium alloy is refined to remove gas and debris in the magnesium alloy melt, and then the magnesium alloy melt is subjected to standing still and cooled to 700° C. to prepare for casting.

(3) Casting: the magnesium alloy melt cooled to 700° C. is cast into a magnesium alloy semi-continuous cast rod crystallizer of a specific specification, and the magnesium alloy can be solidified sequentially by controlling the casting speed, the crystallizer withdrawal speed and the cooling water flow rate to finally form a magnesium alloy semi-continuous cast rod with the length of 10-12 meters.

Figure 1:
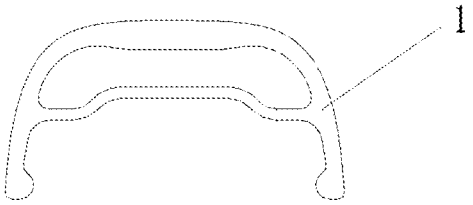
FIG. 1 is a cross-sectional view of a magnesium alloy section bar used as a bicycle rim prepared by the present invention.

(4) The magnesium alloy cast rod and a bicycle rim section bar mold are put into a resistance heating furnace for heating to 300° C., and then the magnesium alloy bar stock is taken out from the heating furnace and put into an extruder preheated to 320° C. in advance for rim section bar extrusion production to obtain a magnesium alloy section bar 1 with the cross section shown as FIG. 1.

Example 2 Preparation of a Magnesium Alloy Section Bar (1) Material Preparation Magnesium alloy components include 6.0% of Zn, 0.6% of Zr, 2.0% of yttrium-rich mixed rare earth and the balance of Mg, wherein the yttrium-rich mixed rare earth includes 26.1% of Y, 16.2% of Nd, 15.8% of Gd, 14.7% of Dy, 11.5% of La, 6.6% of Ce, 4.3% of Pr, 3.2% of Ho and 1.6% of Er.

Mg and Zn are added in the form of a magnesium ingot and a zinc ingot, the magnesium ingot and the zinc ingot are pressed into small pieces, Zr is added in the form of Mg-5Zr master alloy, and the yttrium-rich mixed rare earth is added in the form of Mg-10Re rare earth master alloy.

(2) Smelting

The prepared magnesium ingot is charged into a crucible furnace, the upper surface of the magnesium ingot is covered with a layer of a magnesium alloy smelting covering agent, and the furnace charge is heated to 730° C.; after the magnesium ingot is completely melted, the zinc ingot, and Mg-5Zr master alloy and Mg-10Re rare earth master alloy blocks are added, and after the components are melt, a magnesium alloy melt is fully stirred with a stirrer to make components of the magnesium alloy melt uniform; the melt is subjected to standing still for 15 minutes, the covering agent on the surface of a molten pool is removed by a slag spoon, after the melt is heated to 750° C., a magnesium alloy refining agent is added, the magnesium alloy melt is fully stirred with a stirrer, the magnesium alloy is refined to remove gas and debris in the magnesium alloy melt, and then the magnesium alloy melt is subjected to standing still and cooled to 680° C. to prepare for casting.

(3) Casting: the magnesium alloy melt cooled to 680° C. is cast into a magnesium alloy semi-continuous cast rod crystallizer of a specific specification, and the magnesium alloy can be solidified sequentially by controlling the casting speed, the crystallizer withdrawal speed and the cooling speed to finally form a magnesium alloy semi-continuous cast rod with the length of 10-12 meters.

(4) The magnesium alloy cast rod and a bicycle rim section bar mold are put into a resistance heating furnace for heating to 400° C., and then the magnesium alloy bar stock is taken out from the heating furnace and put into an extruder preheated to 380° C. in advance for rim section bar extrusion production to obtain a magnesium alloy section bar which meets the requirements for rim mechanical properties.

Example 3 Preparation of a Magnesium Alloy Section Bar (1) Material Preparation

Magnesium alloy components include 5.8% of Zn, 0.5% of Zr, 1.2% of yttrium-rich mixed rare earth and the balance of Mg, wherein the yttrium-rich mixed rare earth includes 27.9% of Y, 17.8% of Nd, 14.7% of Gd, 13.3% of Dy, 10.6% of La, 6.1% of Ce, 4.2% of Pr, 3.1% of Ho and 2.3% of Er.

Mg and Zn are added in the form of a magnesium ingot and a zinc ingot, the magnesium ingot and the zinc ingot are pressed into small pieces, Zr is added in the form of Mg-5Zr master alloy, and the yttrium-rich mixed rare earth is added in the form of Mg-10Re rare earth master alloy.

(2) Smelting

The prepared magnesium ingot is charged into a resistance crucible furnace, the upper surface of the magnesium ingot is covered with a layer of a magnesium alloy smelting covering agent, and the furnace charge is heated to 730° C. by energizing; after the magnesium ingot is completely melted, the zinc ingot, and Mg-5Zr master alloy and Mg-10Re rare earth master alloy blocks are added, and after the components are melt, a magnesium alloy melt is fully stirred with a stirrer to make components of the magnesium alloy melt uniform; the melt is subjected to standing still for 15 minutes, the covering agent on the surface of a molten pool is removed by a slag spoon, the melt is heated to 730° C., a magnesium alloy refining agent is added, the magnesium alloy melt is fully stirred with a stirrer, the magnesium alloy is refined to remove gas and debris in the magnesium alloy melt, and then the magnesium alloy melt is subjected to standing still and cooled to 690° C. to prepare for casting.

(3) Casting: the magnesium alloy melt cooled to 690° C. is cast into a magnesium alloy semi-continuous cast rod crystallizer of a specific specification, and the magnesium alloy can be solidified sequentially by controlling the casting speed, the crystallizer withdrawal speed and the cooling speed to form a magnesium alloy semi-continuous cast rod with the length of 10-12 meters at last.

(4) The magnesium alloy cast rod and a bicycle rim section bar mold are put into a resistance heating furnace for heating to 350° C., and then the magnesium alloy bar stock is taken out from the heating furnace and put into an extruder preheated to 360° C. in advance for rim section bar extrusion production to obtain a magnesium alloy section bar which meets the requirements for rim mechanical properties.

Example 4 Preparation of a Magnesium Alloy Section Bar (1) Material Preparation

Magnesium alloy components include 5.8% of Zn, 0.5% of Zr, 1.5% of yttrium-rich mixed rare earth and the balance of Mg, wherein the yttrium-rich mixed rare earth includes 29.8% of Y, 19.7% of Nd, 12.1% of Gd, 10.1% of Dy, 8.0% of La, 9.8% of Ce, 3.1% of Pr, 4.6% of Ho and 2.8% of Er.

Mg and Zn are added in the form of a magnesium ingot and a zinc ingot, the magnesium ingot and the zinc ingot are pressed into small pieces, Zr is added in the form of Mg-5Zr master alloy, and the yttrium-rich mixed rare earth is added in the form of Mg-10Re rare earth master alloy.

(2) Smelting

The prepared magnesium ingot is charged into a resistance crucible furnace, the upper surface of the magnesium ingot is covered with a layer of a magnesium alloy smelting covering agent, and the furnace charge is heated to 700° C. by energizing; after the magnesium ingot is completely melted, the zinc ingot, and Mg-5Zr master alloy and Mg-10Re rare earth master alloy blocks are added, and after the components are melt, a magnesium alloy melt is fully stirred with a stirrer to make components of the magnesium alloy melt uniform; the melt is subjected to standing still for 15 minutes, the covering agent on the surface of a molten pool is removed by a slag spoon, the melt is heated to 740° C., a magnesium alloy refining agent is added, the magnesium alloy melt is fully stirred with a stirrer, the magnesium alloy is refined to remove gas and debris in the magnesium alloy melt, and then the magnesium alloy melt is subjected to standing still and cooled to 690° C. to prepare for casting.

(3) Casting: the magnesium alloy melt cooled to 690° C. is cast into a magnesium alloy semi-continuous cast rod crystallizer of a specific specification, and the magnesium alloy can be solidified sequentially by controlling the casting speed, the crystallizer withdrawal speed and the cooling speed to form a magnesium alloy semi-continuous cast rod with the length of 10-12 meters at last.

(4) The magnesium alloy cast rod and a bicycle rim section bar mold are put into a resistance heating furnace for heating to 300° C., and then the magnesium alloy bar stock is taken out from the heating furnace and put into an extruder preheated to 300° C. in advance for rim section bar extrusion production to obtain a magnesium alloy section bar which meets the requirements for rim mechanical properties.

The mechanical properties of the magnesium alloy section bars prepared in Examples 1 to 4 are tested, and the results obtained are shown as Table 1:

TABLE 1

Mechanical properties of the magnesium alloy section bars prepared in Examples 1 to 3

| | Example 1 | Example 2 | Example 3 | Example 4 |
|---|---|---|---|---|
| Tensile strength | 405 MPa | 397 MPa | 393 MPa | 409 MPa |
| Yield strength | 296 MPa | 287 MPa | 295 MPa | 302 MPa |
| Elongation | 12.9% | 18.7% | 16.8% | 15.2% |

Example 5 Preparation of a Magnesium Alloy Rim

Figure 2:
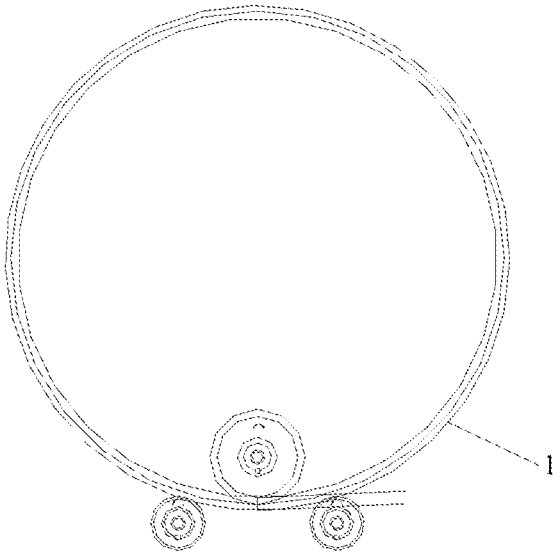
FIG. 2 is a schematic diagram of a coiling process in a preparation method of a magnesium alloy rim of the present invention.
Figure 3:
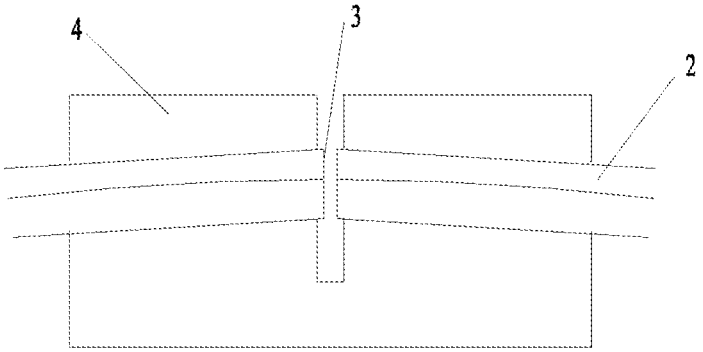
FIG. 3 is a schematic diagram of a cutting process in the preparation method of the magnesium alloy rim of the present invention.
Figure 4:
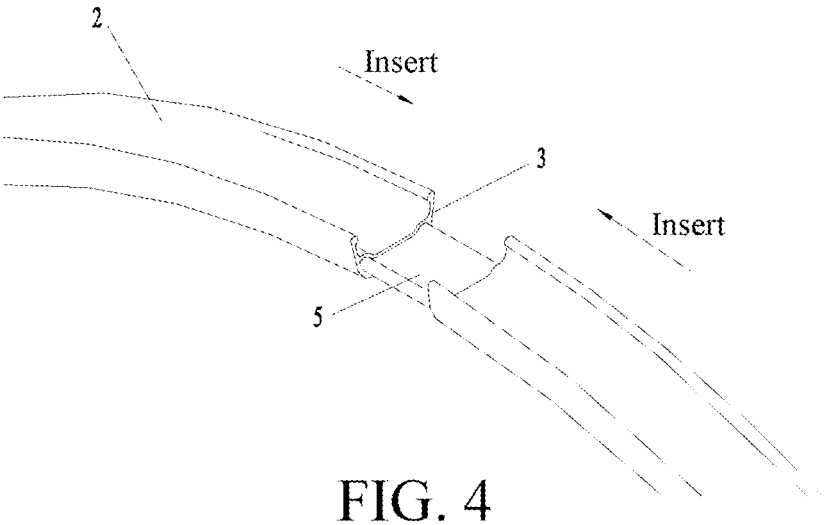
FIG. 4 is a schematic diagram of an inserting process in the preparation method of the magnesium alloy rim of the present invention.
Figure 5:
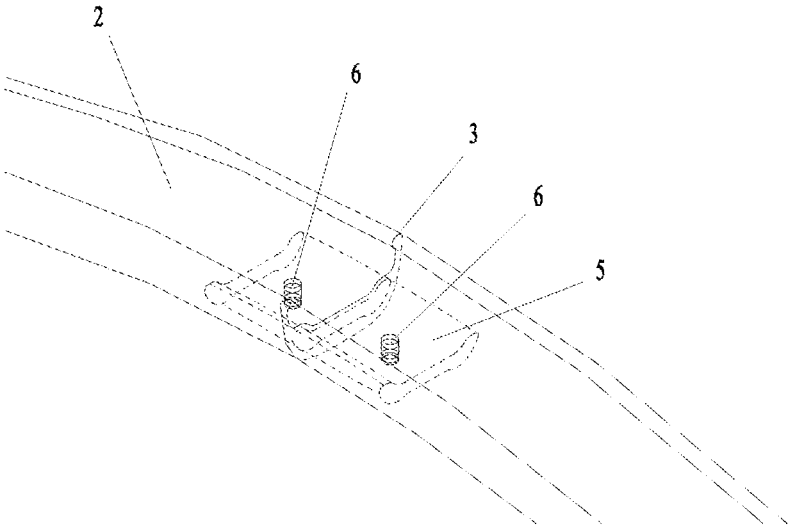
FIG. 5 is a schematic structural diagram of a joint of a prepared magnesium alloy rim.

With the magnesium alloy section bar prepared in Example 3 as a raw material, a magnesium alloy rim is prepared, and the steps are as follows:

① Blanking: the required length of the magnesium alloy section bar is determined according to the diameter of a rim, and sawing is carried out;

② Coiling: as shown in FIG. 2, the magnesium alloy section bar 1 is put on a track of a coiling device, and device parameters are adjusted for coiling according to the diameter of the rim;

③ Cutting: the coiled rim 2 is put on a special cutting device 4, and the excess material near a rim joint 3 is cut, as shown in FIG. 3;

④ Inserting: as shown in FIG. 4, a rim lining connecting piece 5 is inserted into the magnesium alloy section bar at the rim joint 3, then the rim is put on a special inserting machine, and the rim lining connecting piece 5 is fully pressed into the rim joint 3 by using the inserting machine to make the inside of a connector pressed and connected;

⑤ Drilling: the connected rim is put on a rim drilling platform and fixed, and spoke holes are automatically drilled;

⑥ Welding: circular holes 6 with the diameter of 5 mm are drilled respectively in the parts 15 mm away from the both sides of the joint at the inner side of a rim on which a tire is mounted, then the rim lining connecting piece 5 and the rim 2 are fixed by argon arc welding with a welding wire, and the structure of the rim joint is shown as FIG. 5;

⑦ Deburring: after rim welding is completed, burrs and chamfers at the drilling parts and other parts are removed to complete rim processing; and ⑧ Heat treatment: the processed rim is put into a heat treatment furnace, heated to 200° C. and then taken out from the furnace after temperature keeping for 2 hours.

Comparative Example

With the magnesium alloy section bar prepared in Example 3 as a raw material, a magnesium alloy rim is prepared by using a conventional method in the prior art, and the steps are as follows:

① Blanking: the required length of the magnesium alloy section bar is determined according to the diameter of a rim, and sawing is carried out;

② Coiling: as shown in FIG. 2, the magnesium alloy section bar is put on a track of a coiling device, and device parameters are adjusted for coiling according to the diameter of the rim;

③ Cutting: the coiled rim is put on a special cutting device, and the excess material near a rim joint is cut, as shown in FIG. 3;

④ Inserting: as shown in FIG. 4, a rim lining connecting piece after gluing is inserted into the magnesium alloy section bar at the rim joint, then the rim is put on a special inserting machine, and the rim lining connecting piece is fully pressed into the rim joint by using the inserting machine to make the inside of a connector pressed and connected;

⑤ Deburring: after rim welding is completed, burrs and chamfers at the drilling parts and other parts are removed to complete rim processing; and ⑥ Heat treatment: the processed rim is put into a heat treatment furnace, heated to 200° C. and then taken out from the furnace after temperature keeping for 1-2 hours.

The bicycle rims prepared in Example 5 and Comparative Example are tested for rim compressive deformation, and the detection standard is that the compressive deformation of a rim under a load of 500 N for 2 minutes is lower than 1 mm; the test results are shown as Table 2, and it can be seen that the deformation of the bicycle rim prepared in Example 5 is lower than 1 mm, indicating that it meets the use requirements of bicycle rims; and the deformation of the bicycle rim prepared in Comparative Example is higher than 1 mm, and obviously, the compressive deformation of the rim exceeds the standard.

TABLE 2

Test results of compressive deformation of rims

| | Example 5 | Comparative Example |
|---|---|---|
| Compressive deformation of rims | 0.425 mm | 2.351 mm |
| Result judgment | Qualified | Unqualified |

What is claimed is:

1. A magnesium alloy, comprising the following components in percentage by weight of the magnesium alloy:

5.5-6.0% of Zn,
0.3-0.6% of Zr,
0.5-2.0% of a yttrium-rich mixture of rare earth metals, and
the balance of Mg, and wherein the yttrium-rich mixture includes the following components in percentage by weight of the yttrium-rich mixture:

25-30% of Y,
15-20% of Nd,
12-16% of Gd,
10-15% of Dy,
8-12% of La,
6-10% of Ce,
3-6% of Pr,
2-5% of Ho,
1-3% of Er, and
and the balance of other rare earth metals.

2. The magnesium alloy of claim 1, wherein the yttrium-rich mixture consists of the following components in percentage by weight of the yttrium-rich mixture:

25-30% of Y,
15-20% of Nd,
12-16% of Gd,
10-15% of Dy,
8-12% of La,
6-10% of Ce,
3-6% of Pr,
2-5% of Ho, and
1-3% of Er.

3. The magnesium alloy of claim 2, wherein the magnesium alloy consists of the following components in percentages by weight of the magnesium alloy:

5.5-6.0% of Zn,
0.3-0.6% of Zr,
0.5-2.0% of the yttrium-rich mixture of rare earth metals, and
the balance of Mg, and wherein the yttrium-rich mixture consists of the following components in percentage by weight of the yttrium-rich mixture:

25-30% of Y,
15-20% of Nd,
12-16% of Gd,
10-15% of Dy,
8-12% of La,
6-10% of Ce,
3-6% of Pr,
2-5% of Ho, and
1-3% of Er.

4. A method of preparing a magnesium alloy section bar used as a bicycle rim, the method comprising:

preparing a magnesium alloy bar stock, wherein the magnesium alloy bar stock includes a magnesium alloy according to claim 1;

heating the magnesium alloy bar stock to a temperature between 300° C. and 400° C.;

extruding the magnesium alloy bar stock from an extruder to produce a magnesium alloy section bar.

5. The method of claim 4, further including heating a bicycle rim section bar mold to a temperature between 300° C. and 400° C.

6. The method of claim 5, further including heating the extruder to a temperature of between 300° C. and 380° C. before extruding the magnesium alloy bar stock from the extruder.

7. The method of claim 4, wherein the magnesium alloy is prepared using Mg-5Zr master alloy and Mg-10Re rare earth master alloy.

8. The method of claim 4, wherein the magnesium alloy is prepared by directing a magnesium ingot into a furnace;

covering a surface of the magnesium ingot with a covering agent;

heating the magnesium ingot to a temperature of between 700° C. and 730° C. to produce melted magnesium;

adding zinc, Mg-5Zr master alloy, and Mg-10Re rare earth master alloy to the melted magnesium and stirring to obtain a magnesium alloy melt;

allowing the magnesium alloy melt to stand still;

removing the covering agent from the magnesium alloy melt;

heating the magnesium alloy melt to a temperature of between 730° C. and 750° C.;

adding a magnesium alloy refining agent to the magnesium alloy melt and stirring to produce a refined magnesium alloy melt;

allowing the refined magnesium alloy melt to stand still;

cooling the refined magnesium alloy melt to a temperature of between 680° C. and 700° C. to produce a cooled refined magnesium alloy melt.

9. The method of claim 8, further including:

casting the cooled refined magnesium alloy melt in a cast rod crystallizer to form the magnesium alloy bar stock.

10. A method of preparing a magnesium alloy bicycle rim, the method comprising:

providing a magnesium alloy section bar prepared according to claim 4;

cutting and coiling the magnesium alloy section bar to form a coiled magnesium alloy section bar, wherein the coiled magnesium alloy section bar includes two ends forming a joint;

securing a connecting piece to the two ends of the joint of the coiled magnesium alloy section bar to form a connected alloy rim;

heat treating the connected alloy rim to form the magnesium alloy bicycle rim.

11. The method of claim 10, further including removing excess material from the two ends of the joint prior to securing the connecting piece to the two ends of the joint.

12. The method of claim 10, wherein securing the connecting piece to the two ends of the joint includes forming holes in both ends of the joint and the connecting piece and welding the connecting piece to the two ends of the joint.

13. The method of claim 12, wherein an argon arc wire welder is used to weld the connecting piece to the two ends of the joint.

14. The method of claim 10, further including deburring the connected alloy rim before it is heat treated.

15. The method of claim 10, wherein heat treating the connected alloy rim includes heating the connected alloy rim to a temperature of 200° C. for a period of between 1 and 2 hours.

* * * * *